United States Patent [19]

Sato et al.

[11] Patent Number: 5,024,915

[45] Date of Patent: Jun. 18, 1991

[54] POSITIVELY CHARGEABLE DEVELOPER

[75] Inventors: Yukou Sato, Yokohama; Tsutomu Kukimoto, Tokyo, both of Japan

[73] Assignee: Canon Kabushiki Kaisha, Tokyo, Japan

[21] Appl. No.: 437,207

[22] Filed: Nov. 16, 1989

[30] Foreign Application Priority Data

Nov. 17, 1988 [JP] Japan ..... 63-290475

[51] Int. Cl.[5] ..... G03G 9/00; G03G 9/083; G03G 9/107

[52] U.S. Cl. ..... 430/110; 430/111; 430/106.6

[58] Field of Search ..... 430/110, 111, 106.6

[56] References Cited

FOREIGN PATENT DOCUMENTS

| | | | |
|---|---|---|---|
| 2841427 | 3/1979 | Fed. Rep. of Germany | 430/106.6 |
| 0020954 | 2/1985 | Japan | 430/106.6 |
| 1015153 | 1/1986 | Japan | 430/106.6 |
| 2061009 | 3/1987 | Japan | 430/106.6 |

*Primary Examiner*—Marion E. McCamish
*Assistant Examiner*—Stephen Crossan
*Attorney, Agent, or Firm*—Fitzpatrick, Cella, Harper & Scinto

[57] ABSTRACT

A developer for developing electrostatic latent images comprises a toner and a fine silica powder; said fine silica powder being treated with an aminosilane coupling agent having a tertiary amino group represented by the formula:

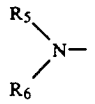

wherein $R_5$ and $R_6$ represent the same or different substituents, provided that the total of the carbon atom number of $R_5$ and $R_6$ is not less than 8, and having an oxidation potential of not more than 800 mV.

36 Claims, No Drawings

POSITIVELY CHARGEABLE DEVELOPER

BACKGROUND OF THE INVENTION

1 Field of the invention

The present invention relates to a positively chargeable developer for developing an electrostatically charged image, used in image forming methods such as electrophotography, electrostatic recording and electrostatio printing. More particularly, it relates to a positively chargeable developer used in direct or indirect electrophotographic development, that is strongly positively chargeable in a uniform state and can make visible a negatively electrostatically charged image, or make visible a positively electrostatically charged image by reversal development, to give a toner image with a high quality.

2. Related Background Art

A large number of methods have been conventionally known as eleotrophotography, as disclosed in U.S. Pat. No. 2,297,691, Japanese Patent Publication No. 42-23910 (U.S. Pat. No. 3,666,363) and Japanese Patent Publication No. 43-24748 (U.S. Pat. No. 4,071,361), etc. In general, copies are obtained by forming an electrostatic latent image on a photosensitive member utilizing a photoconductive material and according to various means, subsequently developing the latent image by using a developer (hereinafter often "toner") to form it into a visible image, and transferring the toner image to a transfer medium such as paper as necessary, followed by fixing by the action of heat, pressure, a pressure hear fixing roller, or solvent vapor. In the case when the process comprises an image transfer step, there is commonly provided a step of removing the toner remaining on the photosensitive member.

As developing processes in which an eleotrostatic latent image is formed into a visible image by using a toner, known methods include the magnetic brush development as disclosed in U.S. Pat. No. 2,874,063, the cascade development as disclosed in U.S. Pat. No. 2,618,552, the powder cloud development as disclosed in U.S. Pat. No. 2,221,776, and the method in which a conductive magnetic toner is used, as disclosed in U.S. Pat. No. 3,909,258.

As toners used in these development processes, there has been hitherto used fine powder obtained by dispersing a dye and/or pigment in a natural or synthetic resin. For example, particles formed by finely grinding a binder resin such as polystyrene comprising a colorant dispersed therein, to have a size of about 1 to 30 $\mu$ are used as the toner. A toner incorporated with magnetic material particles such as magnetite is also used as the magnetic toner. In a system in which a two-component type developer is used, the toner is usually used by mixture with carrier particles such as glass beads and iron powder.

As a method of obtaining a developer capable of controlling positive electrostatic charge, a proposal is seen in Japanese Patent Publication No. 53-22447. This is a method in which a metal oxide powder treated with aminosilane is internally added in the toner particles. Detailed studies on this method made it clear that the method has some problems when, for example, colloidal silica, alumina, titanium dioxide, zinc oxide, iron oxides, $\gamma$-ferrite or magnesium oxide was treated using various aminosilane compounds to obtain developers according to Examples described in the specification of this publication.

Most developers can not retain for a long time the properties desired to make reproduction with fidelity from latent images. They show desirable performance at the beginning, but can not retain the initial properties after continual use for a long period of time and becomes ineffective. For example, after a large number of copies are taken, fogging may occur and, in the copying of line images, black spots of toner may be generated around edges thereof, resulting also in a lowering of image density. As another problem, the development and transfer carried out under environmental conditions of high temperature and high humidity may result in a lowering of image density, and generation of black spots around line images, blank areas, and fog.

An aminosilane coupling agent conventionally used include, for example, the following:

$H_2NCH_2CH_2CH_2Si(OCH_3)_3$ $H_2NCH_2CH_2CH_2Si(OC_2H_5)_3$ $H_2NCH_2CH_2CH_2\overset{\overset{\displaystyle CH_3}{|}}{Si}(OCH_3)_2$ $H_2NCH_2CH_2NHCH_2CH_2CH_2\overset{\overset{\displaystyle CH_3}{|}}{Si}(OCH_3)_2$ $H_2NCONHCH_2CH_2CH_2Si(OC_2H_5)_3$ $H_2NCH_2CH_2NHCH_2CH_2CH_2Si(OCH_3)_3$ $H_2NCH_2CH_2NHCH_2CH_2NHCH_2CH_2CH_2Si(OCH_3)_3$

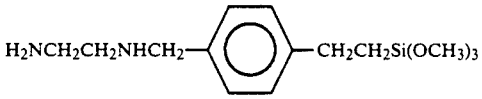

$HOCH_2CH_2$
$\diagdown$
$N-CH_2CH_2CH_2Si(OCH_3)_3$
$\diagup$
$HOCH_2CH_2$ $(H_2CO)_3SiCH_2CH_2CH_2-NHCH_2$
$(H_2CO)_3SiCH_2CH_2CH_2-NHCH_2$ $(H_5C_2O)_3SiCH_2CH_2CH_2$
$\diagdown$
$NH$
$\diagup$
$(H_5C_2O)_3SiCH_2CH_2CH_2$ $H_3CNHCH_2CH_2CH_2Si(OC_2H_5)_3$ $H_2N(CH_2CH_2NH)_2CH_2CH_2CH_2Si(OCH_3)_3$ $H_3N-NHCONHC_3H_6Si(OCH_3)_3$ The silica treated with these aminosilane coupling agents, when used as an additive of the toner, causes water absorption or moisture absorption as a result of the copying under conditions of high temperature and high humidity, resulting in a lowering of image density. It also brings about changes with time during long-term storage of the toner to cause image deterioration such as ground fogging or reveral fogging. When the aminosilane coupling agents as described above are used, a hydrophobic property imparting agent is usually used in combination so that the toner may have environmental resistance and triboelectric stability.

Japanese Unexamined Patent Publication No. 59-34539 (corresponding to U.S. Pat. No. 4,618,556) discloses a method in which a positively chargeable silica prescribed to have hydrophobic property within a specified range is used as a component of a positively chargeable toner. The positively chargeable silica subjected to hydrophobic treatment, however, has the problem that the reversal fogging becomes more serious with an increase in the hydrophobic property. In general, when a powder treated with an agent for making it hydrophobic is frictionally charged together with ion powder, it has the property of being negatively charged and tends to be strongly negatively chargeable with an increase in the hydrophobic property. Thus, this tends to be the cause of generating the reversal fogging in the state that no sufficient electrostatic charges have been imparted to the toner as in the initial state of copying.

Conventional agents for making the toner hydrophobic are exemplified by the following: Hexamethyldisilazane, trimethylsilane, trimethylchlorosilane, trimethylethoxysilane, dimethyldichlorosilane, methyltrichlorosilane, allyldimethylchlorosilane, allylphenyldichlorosilane, benzyldimethylchlorosilane, bromomethydimethylchlorosilane, α-chloroethyltrichlorosilane, β-chloroethyltrichlorosilane, chloromethyl-dimethylchlorosilane, triorganosilylmercaptane, trimethylsilylmercaptane, triorganosilylacrylate, vinyldimethylacethoxysilane, and also dimethylethoxysilane, dimethyldimethoxysilane, diphenyldiethoxysilnane, hexamethyldisiloxane, 1,3-divinyltetramethyldisiloxane, 1,3-diphenyltetramethyldisiloxane, and a dimethylpolysiloxane having 2 to 12 siloxane units per molecule and containing in the unit positioned at the terminal a hydroxy group bonded to Si for each one. These are used alone or in the form of a mixture of two or more kinds.

Japanese Unexamined Patent Publication No. 59-201063 (corresponding to U.S. Pat. No. 4,568,625) discloses a method of obtaining the positively chargeable toner. This is a method in which fine powder of silica treated with silicone oil containing amine in the side chain is incorporated into a developer.

Detailed studies of this method confirmed that the image quality, density and fog were all in good states in commonly available copying machines even when a large number of copies were taken. When, however, the above toner is loaded into a high-speed copying machine (process speed: not less than 300 mm/s), a copying machine that can achieve multi-color development, and a digital copying machine having a low potential contrast of the image, the initial properties can not be retained after the continual use of the toner for a long period of time and the problem of the reversal fogging tends to occur.

Besides the fine silica powder, it is also known to add other additives in the developer. For example, Japanese Patent Publications No. 48-8136, No. 48-8141 and No. 51-1130 teach that a friction-reducing material such as polyvinylidene fluoride powder is used as an additive of the developer. Detailed studies on this method, however, revealed that the method effectively prevents the poorness in cleaning resistance and the melt-adhesion of toner to a drum, but on the other hand has the problems that the sharpness of toner images may be extremely lowered, the latent images on the photosensitive member tend to be deformed under conditions of high temperature and high humidity, and the stability in duration is unsatisfactory.

As a method of improving the cleaning performance, Japanese Unexamined Patent Publication No. 61-160760 (corresponding to U.S. Pat. No. 4,666,813 discloses a method in which fine particles of specific polyvinylidene fluoride are externally added to the toner. Detailed studies on this method obtained a good result particularly in relation to the cleaning performance. In some instances, however, a lowering of image density is seen when the toner is loaded in the high-speed copying machine and tested for long-term duration.

SUMMARY OF THE INVENTION

Accordingly, an object of the present invention is to provide a positively chargeable developer that has a satisfactory frictional chargeability and can obtain a good image free from ground fogging and reversal fogging.

Another object of the present invention is to provide a positively chargeable developer that can maintain a good image quality even when the developer is continually used over a long period of time.

Still another object of the present invention is to provide a positively chargeable developer capable of reproducing a stable image and not affected by the variation of temperature and humidity.

A further object of the present invention is to provide a positively chargeable developer than can retain a good cleaning performance.

The above objects of the present invention can be achieved by a positively chargeable developer for developing electrostatic latent images, comprising a toner and a fine silica powder; said fine silica powder being treated with an aminosilane coupling agent having a tertiary amino group represented by the formula:

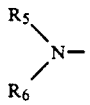

wherein R5 and R6 represent the same or different substituents, provided that the total of the carbon atom number of $R_5$ and $R_6$ is not less than 8, and having an oxidation potential of not more than 800 mV.

DETAILED DESCRIPTION OF THE PREFERRED EMBODIMENTS

In the present invention, the aminosilane coupling agent having the tertiary amino group, used in the surface treatment of fine silica powder, may preferably include the compounds represented by the following formula:

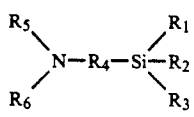

wherein $R_1$ represents an alkoxy group; $R_2$ and $R_3$ may be the same or different and each represent an alkoxy group, an alkyl group or an aryl group; $R_4$ represents an alkylene group or a phenylene group; and $R_5$ and $R_6$ may be the same or different and each represent an alkyl group or an aryl group, preferably aryl group having 6 to 12 carbon atoms, provided that the alkylene group or phenylene group may have an amino group.

The hydrogen atom possessed by $R_4$ may be substituted with a halogen atom to the extent that the positive chargeability of the fine silica powder thus treated may not be adversely affected. $R_1$, $R_2$ and $R_3$ may each preferably be a group having 1 to 4 carbon atoms, $R_4$ may preferably be a group having 2 to 10 carbon atoms, and $R_5$ and $R_6$ may each preferably be a group having 2 to 12 carbon atoms.

The following aminosilane coupling agents are specifically exemplified.

$$(H_9C_4)_2NCH_2CH_2CH_2-Si-(OCH_3)_3$$

$$(H_9C_4)_2NCH_2CH_2CH_2-Si-(OC_2H_5)_3$$

$$(H_{17}C_8)_2NCH_2CH_2CH_2-\overset{CH_3}{\overset{|}{Si}}-(OCH_3)_2$$

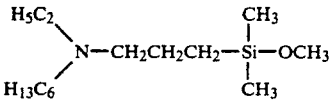

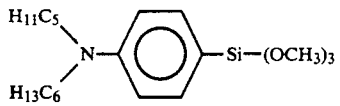

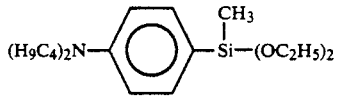

The aminosilane coupling agents according to the present invention are available from Toray Silicone C., Ltd. or Shin-Etsu Chemical Co., Ltd.

The fine silica powder contained in the developer of the present invention is treated with the aminosilane coupling agent having an oxidation potential of not more than 800 mV, and preferably not more than 700 mV. An oxidation potential more than 800 mV may result in an unsatisfactory chargeability of the silica treated and makes it impossible to obtain a satisfactory image density particularly under conditions of high temperature and high humidity.

The fine silica powder contained in the developer of the present invention may preferably be made hydrophobic to a degree of not less than 50, measured in a wetting degree test. A degree less than 50 makes it impossible to obtain a satisfactory image density under conditions of high temperature and high humidity due to the hygroscopicity of the silica. A degree not more than 20 may result in a low image density even under conditions of normal temperature and normal humidity.

Thus, the employment of the silica treated with the aminosilane having an oxidation potential of not more than 800 mV and in which the amino group at the terminal Of the aminosilane coupling agent is formed of a tertiary amine and the total of the carbon atom number of the groups, containing no silicon, among the tertiary amino substituents, is not less than 8 makes it possible to be very satisfactory in the hydrophobic property and chargeability and achieve good image quality and durability when it is used as a mixture with the toner.

The above fine silica powder is treated, for example, in the following way: The fine silica powder is vigorously stirred, optionally with heating, during which the treating agent or a solution thereof is sprayed as it is or after having been vaporized. Alternatively, the fine silica powder is previously formed into a slurry, and while it is stirred, the treating agent or a solution thereof is dropwise added therein. The surface can be thus treated. Thereafter, the powder thus treated may preferably be further heated at a temperature of from about 50° to 350° C.

As the fine silica powder that serves as a component of the developer in the present invention, a silicic acid powder prepared by the dry process or wet process can be used. The fine silica powder prepared by the dry process is preferred since it can be finer and have a higher fluidity than the silica prepared by the wet process.

The dry process herein mentioned refers to a process of preparing a fine silica powder formed by vapor phase oxidation of a silicon halide. For example, it is a process that utilizes heat decomposition oxidation reaction in the oxyhydrogen flame of silicon tetrachloride gas. The reaction basically proceeds as follows.

$$SiCl_4+2H_2+O_2\rightarrow SiO_2+4HCl$$

In this preparation step, it is also possible to use a metal halide such as aluminum halide or titanium chloride together with the silicon halide to give a composite fine powder of silica and another metal oxide. The silica according to the present invention includes these, too.

Commercially available fine silica powders used in the present invention, produced by the vapor phase oxidation of the silicon halide, include, for example, those which are on the market under the following trade names.

Aerosil I30, 200, 300, 380, OX50, TT600, MOX80, MOX170 COK84 (Aerosil Japan, Ltd.):

Ca-O-SiL M-5, MS-7, MS-75, HS-5, EH-5 (CABOT CO.);

Wacker HDK N 20 V15, N20E, T30, T40 (WACKER-CHEMIE GMBH);

D-C Fine Silica (Dow-Corning Corp.); and

Fransol (Franzil Co.).

On the other hand, as the wet process preparation method for the fine silica powder used in the present invention, various conventionally known methods can be applied. For example, they include the decomposition of sodium silicate in the presence of an acid, a reaction scheme of which is shown below.

$$Na_2O.XSiO_2+HCl+H_2O\rightarrow SiO_2.nH_2O+NaCl$$

Besides, they include the decomposition of sodium silicate in the presence of ammonium salts or alkali salts, a method in which an alkaline earth metal silicate is produced from sodium silicate, followed by decomposition in the presence of an acid to form silicic acid, a method in which a sodium silicate solution is formed into silicic acid through an ion-exchange resin, and a method in which naturally occurring silicic acid or silicate is utilized.

In the fine silica powder herein mentioned, there can be applied anhydrous silicon dioxide (silica), as well as silicates such as aluminum silicate, sodium silicate, potassium silicate, magnesium silicate, and zinc silicate.

Commercially available fine silicic acid powders synthesized by the wet process include, for example, those which are on the market under the following trade names.

| | |
|---|---|
| Carplex | Shionogi & Co., Ltd. |
| Nipsil | Nippon Silica Co., Ltd. |
| Tokusil | Tokuyama Soda Co., Ltd. |
| Finesil | " |
| Vitasil | Taki Fertilizer Manufacturing Co., Ltd. |
| Silton, Silnex | Mizusawa Kagaku Co., Ltd. |
| Starsil | Kamishima Kagaku Co., Ltd. |
| Himezil | Ehime Yakuhin Co., Ltd. |
| Sailoid | Fuji-Davison Co., Ltd. |
| Hi-Sil | Pittsburgh Plate Glass Co. |
| Durosil | Fullstoff-Gesellschaft Marquart |
| Ultrasil | " |
| Manosil | Hardman and Holden |
| Hoesch | Chemische Fabrik Hoesch K-G |
| Sil-Stone | Stone Rubber Co. |
| Nalco | Nalco Chemical Co. |
| Quso | Philadelphia Quaetz Co. |
| Imsil | Illinis Minerals Co. |
| Calcium Silikat | Chemische Fabrik Hoesch K-G |
| Calsil | Fullstoff-Gesellschaft Marquart |
| Fortafil | Imperial Chemical Industries, Ltd. |
| Microcal | Joseph Crosfield & Sons, Ltd. |
| Manosil | Hardman and Holden |
| Vulkasil | Farbenfabiken Bryer, A.-G. |
| Tufknit | Durham Chemicals, Ltd. |
| Silmos | Shiraishi Kogyo Co., Ltd. |
| Starlex | Kamishima Kagaku Co., Ltd. |
| Fricosil | Taki Fertilizer Manufacturing Co., Ltd. |

Of the above fine silicic acid powders, those having a specific surface area of not less than 30 $m^2/g$, and particularly ranging from 50 to 400 $m^2/g$, according to nitrogen adsorption measured by BET method, give good results.

The "oxidation potential" prescribed in the specification concerning the present invention is measured in the following way.

It is measured using platinum electrodes as the sample electrode and the counter electrode, using a saturated calomel electrode as the reference electrode, and using 0.1N n-tetrabutylammonium perchloride as the support electrolyte. It is also possible to use other measuring methods while making reference to the measuring method in the present invention. As solvents, those capable of dissolving each sample compound were selected in every instance. The developer that employs the fine silica powder treated with the aminosilane coupling agent having an oxidation potential of not more than 800 mV, measured by such a method, has a satisfactory chargeability and is superior in view of the environmental resistance and triboelectric stability.

The silica treated with the aminosilane coupling agent, having been made hydrophobic to a degree of wetting of not less than 50, can be preferably used in the present invention. The "degree of wetting" herein mentioned is obtained by the following test.

In a 200 ml separatory funnel, 1.0 g of sample fine silica particles are collected, and 100 ml of ion-exchanged water is added using a graduated cylinder. Next, the separatory funnel is set in a Turbula-shaker mixer TC-2 Type, and the contents are dispersed at 90 r.p.m. for 10 minutes. The separatory funnel is detached from the Turbula-shaker mixer TC-2 Type, and left to stand for 10 minutes. Thereafter, 20 to 30 ml of the dispersion is draw out of the separatory funnel, and then dispensed into a 10 mm cell. Using ion-exchanged water as a blank (100%), the turbidity of a water layer at a wavelength of 500 nm is measured with a colorimeter. The value read in this measurement (tranSmittance T%) is regarded as the degree of wetting.

Here, in the case when the silica is entirely wet with water, the degree of wetting is regarded as 0.

The triboelectric value of the fine silica particles according to the present invention is measured by the following method: A fine silica powder left to stand overnight in an environment of 25° C. and 50 to 60% RH is mixed with iron powder carrier having a particle diameter of 200 mesh-pass/ 300 mesh-on, in a weight proportion of 2:98. The resulting mixture is precisely weighed out to give 0.5 to 1.5 g, and attracted on a 400 mesh metal screen connected with an electrometer, under application of a pressure of 25 om $H_2O$, where the amount of triboelectric charges per unit weight is determined from the separated and attracted fine silica particles and the amount of electrostatic charges thereof.

The surface-treated fine silica particles, having triboelectric charges in an amount of from +100 μc/g to +300 μc/g, measured by the above method, are used in the present invention.

The effect is exhibited when these fine silica particles are used in an amount of from 0.05 to 10 parts by weight based on 100 parts by weight of the toner, and a developer showing positive chargeability with excellent stability can be provided when it is used particularly preferably in an amount of from 0.1 to 3 parts by weight. As for a preferred embodiment for the form of addition, it is preferred that 0.01 to 1 part by weight of the surface-treated fine silica powder, based on 100 parts by weight of the toner, is adhered on the surfaces of toner particles.

In the present invention, the fine silica particles may preferably be used in combination with a negatively chargeable fine fluorine resin particles, which are then used as a mixture with a positively chargeable toner. These fine particles that satisfy the above values of physical properties give the positively chargeable developer having better development performance, environmental resistance and durability than the conventiOnal toners.

The negatively chargeable fine fluorine resin particles, preferably used in the present invention, are prepared by a method such as spray drying, suspension polymerization, emulsion polymerization, seed polymerization, or mechanical pulverization. The fine resin particles of the present invention may be selected from the fine particles of fluorine resins such as polyvinyl fluoride (PVF), polytetrafluoroethylene (PTFE), polyvinylidene fluoride (PVDF), and perfluoroalkoxy fluorine resins (PFA). In particular, polyvinylidene fluoride (PVDF) is preferred in view of its ability to feed and disperse the positively chargeable silica to positively chargeable toner particles and also in view of its function as a cleaning aid.

The amount of triboelectric charges of the negatively chargeable fine fluorine resin particles is measured in the following way: In a pot made of aluminum, having a volume of about 200 cc, 2 g of the fine resin particles left to stand overnight in an environment of 25° C. and 50 to 60% RH and 98 g of carrier iron powder (e.g., EFV200/300; a product of Nihon Teppun Co.. Ltd.) not coated with resin, having a main particle size of from 200 to 300 mesh, are thoroughly mixed (vertically shaken about 50 times in hands) in the above environment, and the amount of triboelectric charges of the fine resin particles is measured by the conventional blow-off method, using an aluminum cell having a 400 mesh screen.

The amount of triboelectric charges of the negatively chargeable fine fluorine resin particles may preferably range from $-10$ μc/g to $-40$ μc/g.

In the present invention, regarding the measurement of the degree of crystallization of the negatively chargeable fine fluorine resin particles, the value derived from the following measuring method is regarded as the degree of crystallization. This is a method in which the value is obtained from the heat of fusion determined from a fusion peak of a differential scanning calorimeter (DSC). Using about 20 mg of a sample, measurement is made at a rate of temperature rise of 10° C./min for temperatures of from 50° to 200° C., and the heat of fusion, ΔH(cal/g) of this sample is calculated from the ratio of the area of the fusion peak at this time to the area of the fusion peak of the reference indium. Assuming the heat of fusion of a perfect crystal as $\Delta Hc = 15$ cal/g, here is used the value obtained from the degree of crystallization $= \Delta H/\Delta Hc \times 100$ (%).

The fine resin particles used in the present invention may preferably have a degree of crystallization of not less than 60%, and more preferably not less than 70%. A degree of crystallization which is less than 60% highly tends to cause the problems of a lowering of image density and a fogging when a latent image has a low development contrast or the high speed development is carried out.

The above fine resin particles may be controlled to have a primary average particle diameter of from 0.01 to 4 μm, and preferably from 0.1 to 3 μm.

Pulverization, disintegration or classification may be operated to control the average particle diameter. As to the primary average particle diameter, images of secondary particles are photographed at 20,000 to 100,000 magnifications using a scanning electron microscope, and the average particle diameter of several ten to several hundred primary particles is determined from the resulting photograph.

A primary average particle diameter more than 4 μm, of the fine resin particles may cause fogging undesirably. On the other hand, a primary average particle diameter less than 0.01 μm can hardly bring about the effect of addition.

The above fine resin particles may be in an amount of from 0.01 to 5.0 parts by weight, and preferably from 0.05 to 2.0 parts by weight, based on 100 parts by weight of the toner particles. An amount more than 5 parts by weight may result in an increase in fog because of the presence of release matters not adhering to the toner particles, and may cause a density unevenness in an environment of high temperature and high humidity. The addition thereof in an amount less than 0.01 part by weight may bring about little effect.

The above negatively chargeable fine fluorine resin particles uniformly impart positively chargeable silica particles to the surfaces of the positively chargeable toner particles, and hence make it possible to generate stable positive charges. Even under severe development conditions that the development under a low contrast of a latent image or the high-speed development is continued for a long time, the above fine resin particles act as cushioning materials, so that the developer may deteriorate with difficulty and a stable image quality can be obtained from the initial stage for a long period of time.

Binder resins for the toner according to the present invention ar exemplified by homopolymers of styrene and substituted products thereof, such as polystyrene and polyvinyltoluene; styrene copolymers such as a styrene-propylene copolymer, a styrene-vinyltoluene copolymer, a styrene-vinylnaphthalene copolymer, a styrene-methyl acrylate copolymer, a styrene-ethyl acrylate copolymer, a styrene-butyl acrylate copolymer, a styrene-octyl acrylate copolymer, a styrene-dimethylaminoethyl acrylate copolymer, a styrene-methyl methacrylate copolymer, a styrene-ethyl methacrylate copolymer, a styrene-butyl methacrylate copolymer, a styrene-dimethylaminoethyl methacrylate copolymer, a styrene-vinylmethylether copolymer, a styrene-vinylethylether copolymer, a styrene-vinylmethylketone copolymer, a styrene-butadiene copolymer, a styrene-isoprene copolymer, a styrene-maleic acid copolymer, and a styrene-maleate copolymer; polymethyl methacrylate, polybutyl methacrylate, polyvinyl acetate, polyethylene, polypropylene, polyurethane, polyamide, polyvinylbutyral, polyamide, polyacrylic resins, rosin, modified rosin, terpen resins, phenol resins, aliphatic or alicyclic hydrocarbon resins, aromatic petroleum resins, paraffin wax, and carnauba wax. These can be used alone or by mixture. In particular, styrene polymers are preferred.

Colorants that can be added in the positively chargeable developer of the present invention include dyes and pigments. For example, carbon black, copper phthalocyanine and black iron oxide can be used.

A positive chargeability controlling agent such as Nigrosine or a quaternary ammonium salt can be used in the toner of the present invention. The positively chargeable toner used in the present invention may preferably be made to have an amount of triboelectric charges of from $+9$ μc/g to $+20$ μc/g, using the positive chargeability controlling agent or a positively chargeable resin.

The positively chargeable toner particles of the present invention mean toner particles in which the amount of triboelectric charges becomes positive when similarly measured on toner particles left to stand overnight in an environment of 25° C. and 50 to 60% RH, after toner particles and carrier iron powder are mixed in a proportion of 10:90 in the method of measuring the amount of triboelectric charge of silica as previously described.

The amount of triboelectric charges of the positively chargeable toner particles of the present invention may favorably range from $+5$ μc/g to $+40$ μc/g, preferably from $+9$ μc/g to $+20$ μc/g, and more preferably from $+9$ μc/g to $+15$ μc/g.

The toner particles may have a volume average particle diameter of from 5 to 30 μm, preferably from 5 to 20 μm, and more preferably from 7 to 15 μm.

The particle diameter of the toner is measured in the following way: Coulter Counter TA-II Type (manufactured by Coulter Electronics Inc.) is used as a measuring apparatus, to which Interface (manufactured by Nikkaki) that outputs number average distribution and volume average distribution and CX-I Personal Computer (manufactured by Canon Inc.) are connected. As an electrolytic solution, an aqueous 1% NaCl solution is prepared using first-grade sodium chloride. In 1OO to 150 ml of the aqueous electrolyric solution, 0.1 to 5 ml of a surface active agent (preferably an alkylbenzene sulfonate) is added as a dispersant, and 0.5 to 50 mg of the sample to be measured is further added. The electrolytic solution in which the sample has been suspended is put in an ultrasonic dispersing machine, and dispersion treatment is carried out for about 1 to 3 minutes. Particle size distribution of the particles of 2 to 40 μ is measured with the above Coulter Counter TA-II Type, using a 100 μ aperture as an aperture, to determine the volume average distribution and number average distribution.

On account of triboelectric chargeability and electrostatic transfer performance, it is preferred for the toner according to the present invention to have a volume specific resistance of not less than $10^{10}\Omega$.cm, and particularly not less than $10^{12}\Omega$.cm. The volume specific resistance herein mentioned is defined as the value calculated from an electric current value observed when the toner is molded under pressure of 100 kg/cm$^2$, an electric field of 100 V/cm is applied to the resulting mold and 1 minute has lapsed after the application of electric field.

As magnetic fine particles contained in the toner in an embodiment in which the toner according to the present invention comprises a magnetic toner, substances that are magnetized when placed in a magnetic field are used. There can be used powder of ferromagnetic metals such as iron, cobalt and nickel, or alloy powder thereof, or powder of compounds such as magnetite, $\gamma$-$Fe_2O_3$ and ferrite Preferred are magnetic iron oxide particles in which Si element is present so that its quantity gradually increases from the surfaces of the particles to centers.

On account of moisture resistance, the Si element may preferably be contained in the magnetic irOn oxide in an amount of from 0.1 to 1.5% by weight, more preferably from 0.20 to 1.0%, and still more preferably from 0.25 to 0.70% by weight, based on Fe element. An amount less than 0.1% by weight may result in a poorness in the effect of improving the properties of particles as desired in the present invention. An amount more than 1.5% by weight may undesirably result in an increase in the silicic acid component remaining on the particle surfaces.

The magnetic iron oxide used in the magnetic toner according to the present invention has a content A (based on the iron element) of silicon element present up to about 10% by weight dissolution of iron element of about 0.7% by weight or less, preferably 0.01 to 0.5% by weight, and a content B (based on the iron element of silicon element in the range of 90 to 100% by weight dissolution of the iron element of 0.2 to 5% by weight, preferably 0.5 to 3% by weight. The content A of the silicon element up to about 10% by weight dissolution of iron element refers to the content of silicon element at the most peripheral area and surface of the magnetic iron oxide particles. A value thereof more than 0.7% by weight may result in heterogeneousness of the surface composition of the magnetic iron oxide or loss of moisture resistance because of the silicic acid component, highly tending to bring about no satisfactory achievement of the effect aimed in the present invention. The content B of the silicon element in the range of 90 to 100% by weight dissolution of the iron element refers to the content of silicon element at the center of the magnetic iron oxide particles. A content less than 0.2% by weight may result in a non-uniform particle size distribution, tending to make it difficult to achieve uniform composition or structure of each magnetic iron oxide particle. A content more than 5% by weight may cause an increase of the viscosity of a reaction mixture in the course of manufacture, resulting not only in a poor efficiency but also in inhibition of uniform reaction in a reaction vessel, thus tending to bring about a magnetic iron oxide some of particles of which have no uniform constitution.

In the magnetic iron oxide of the present invention, the ratio of content B/content A is not less than 1.0, and preferably ranges from 3 to 10. A ratio of less than 1.0, of the content B/content A may result in an insufficient amount of the silicic acid component present in the nuclei of magnetic iron oxide at the initial stage for the formation of the magnetic iron oxide, tending to make it difficult to prepare magnetic iron oxide particles with a uniform particle size and a sharp particle size distribution.

The contents A and B of Si in the magnetic iron oxide can be measured by the method as described in Japanese Unexamined Patent Publication No. 62-279352 (corresponding to U.S. Pat. No. 4,820,603).

The magnetic powder may be contained in an amount of from 10 to 70% by weight based on toner weight. On account of the prevention of fogging at the time of reversal development, it may preferably be contained in an amount of from 35 to 60% by weight, and more preferably from 37 to 47% by weight.

Methods of preparing the toner of the present invention are exemplified by a method in which component materials are thoroughly kneaded using a heat kneading machine such as a heat roll mixer, a kneader or an extruder, followed by mechanical grinding and classification to give the toner; a method in which materials are dispersed in a binder resin solution, followed by spray drying to give the toner; and a method of preparing the toner by polymerization, in which prescribed materials are mixed in a monomer that constitutes a binder resin, to give an emulsion, which is then polymerized.

The present invention will be described below by giving Examples. In the following formulation, "part(s)" is by weight.

EXAMPLE 1

| | |
|---|---|
| Styrene/butyl methacrylate copolymer (copolymerization ratio: 80/20; weight average molecular weight Mw: about 200,000) | 100 parts |
| Magnetite (average particle diameter: 0.2 μ) | 60 parts |
| Low molecular polyethylene wax | 4 parts |
| Nigrosine | 3 parts |

The above materials were thoroughly blended with a blender, followed by kneading with a twin-roll kneader heated to 150° C. The kneaded product was left to cool and thereafter crushed with a cutter mill, followed by pulverization using a jet-air fine pulverizer and further by classification using an air classifier. A fine black powder with a number average particle diameter of 10 μ (volume average particle diameter: 12 μ) was thus obtained as a positively chargeable black toner (amount of triboelectric charges: +10μc/g).

On the other hand, 100 parts of a fine silica powder (specific surface area: about 200 m$^2$/g) synthesized by the dry process was stirred, during which its temperature was maintained at about 200° C. Using dibutylaminopropyltrimethoxysilane (oxidation potential: 670 mV) as a treating agent, 20 parts of this agent was sprayed on the above fine silica powder and treated for 30 minutes.

The resulting treated fine silica powder (fine silica powder A; amount of triboelectric charges: +200 μc/g) had a degree of wetting, of 57. To 100 parts of the above black toner, 0.4 part of this treated fine silica powder, 0.5 part of fine polyvinylidene fluoride particles (degree of crystallization: 70%; primary average particle diameter: 0.4 μm: amount of triboelectric charges: −22 μc/g) were added, and there were blended to give a one-component type positively chargeable developer.

This developer was applied in a commercially available multiple two-color copying machine (trade name: NP-5540; manufactured by Canon Inc.) and images were produced.

The copying machine NP-5540 is a one-touch multiple two-color copying machine equipped with a photosensitive drum having a laminate type organic photoconductive material (OPC), and employs a multi-stage developing unit. In this copying machine, a System is employed in which part of the latent image on the photosensitive drum is erased with an LED or a fuse lamp, and another image is inserted to the corresponding part. Thus, the drum potential ($V_{SL}$) at the part erased with an LED is greatly lowered and the difference between the drum potential and the DC bias ($V_{DC}$) at the time of development, i.e., $|V_{DC}-V_{SL}|$, is larger than conventional copying machines, so that a toner with a larger reversal fog latitude is required. Here, VDC is changed and the tolerance limit VDC of reversal fog at the $V_{SL}$ part is assumed as $V'_{DC}$. As a result, a reversal fog latitude of as good as 300 V. for $|V'_{DC}-V_{SL}|$ was shown at the initial stage and also the image density was well as high as 1.35. Using this developer, transferred toner images were continuously produced to examine its durability. Transferred images after 40,000 sheet copying were also found to be not inferior to the initial images. On the other hand, copying was tested under environmental conditions of high temperature and high humidity (35° C., 85% RH) or low temperature and low humidity (15° C., 10% RH). As a result, fog-free good images were obtained in 10,000 sheet duration.

EXAMPLES 2 to 4

Example 1 was repeated to prepare a positively chargeable developer, except that fine silica powder A used in Example 1 was replaced with fine silica powder B, C or D as shown in Table I.

TABLE 1

| Fine silica powder | Parent silica specific area | Treating agent | Oxidation potential | Degree of wetting | Amount of triboelectric charge |
|---|---|---|---|---|---|
| B | 200 $m^2/g$ | * | 650 mV | 52 | +190 μc/g |
| C | 200 m2/g | ** | 600 mV | 70 | +220 μc/g |
| D | 300 $m^2/g$ | *** | 620 mV | 63 | +220 μc/g |

*Dibutylaminomethyltrimethoxysilane
**Dioctylaminopropyltrimethoxysilane
***Dihexylaminopropyltrimethoxysilane Results of development are shown in Tables 2 and 3.

TABLE 2

| Example | Fine silica powder | 23.5° C., 65% RH Initial density | Initial reversal fog $\|V'_{DC}-V_{SL}\|$ | After 50,000 sheet duration: Density | After 50,000 sheet duration: $\|V'_{DC}-V_{SL}\|$ |
|---|---|---|---|---|---|
| 2 | B | 1.35 | ≧330 V | 1.30 | ≧250 V |
| 3 | C | 1.30 | ≧330 V | 1.27 | ≧280 V |
| 4 | D | 1.30 | ≧330 V | 1.25 | ≧260 V |

TABLE 3

| Example | Fine silica powder | 35° C., 80% RH Initial density | Initial reversal fog $\|V'_{DC}-V_{SL}\|$ | After 50,000 sheet duration: Density | After 50,000 sheet duration: $\|V'_{DC}-V_{SL}\|$ |
|---|---|---|---|---|---|
| 2 | B | 1.30 | ≧330 V | 1.27 | ≧300 V |
| 3 | C | 1.25 | ≧330 V | 1.28 | ≧300 V |
| 4 | D | 1.23 | ≧330 V | 1.28 | ≧300 V |

As the above shows, fog-free good images with a well high density were obtained both at the initial stage and after 50,000 sheet duration, even at normal temperature and normal humidity or high temperature and high humidity.

COMPARATIVE EXAMPLE 1

Example 1 was repeated except that the fine silica powder A used in Example 1 was replace with a fine silica powder (degree of wetting: 0) prepared using γ-aminopropyltrimethoxysilane (oxidation potential: 900 mV as the treating agent. The reversal fogging and the durability were on the level slightly poorer than those in Example 1, and good results were seen. In the environment of 35° C. and 85% RH, however, the initial density was greatly lowered to 0.80.

COMPARATIVE EXAMPLE 2

Example 1 was repeated except that fine silica powder A used in Example 1 was replaced with a fine silica powder (degree of wetting: 45) prepared using aminopropyltrimethoxysilane (oxidation potential: 900 mV) and hexamethyldisilazane (an agent for making the powder hydrophobic) as treating agents. However, the reversal fog latitude $|V'_{DC}-V_{SL}|$ was as low as 160 V. Although the initial density was as high as 1.30, the density was lowered to 1.12 after 10,000 sheet duration. In the environment of 35° C. and 85% RH, the initial image density was 0.95.

COMPARATIVE EXAMPLE 3

Example 1 was repeated except that fine silica powder A used in Example 1 was replaced with an untreated fine silica powder (degree of wetting: 0) and the fine polyvinylidene fluoride particles were not used. The reversal fogging was in a good state, but the initial density even in the environment of 23.5° C. and 65% RH was as low as 0.75, and the image density was also unsatisfactory. The images obtained in the environment of 35° C. and 85% RH were poor and also had an initial density of 0.50.

EXAMPLE 5

| | |
|---|---|
| Styrene/n-butyl acrylate copolymer (copolymerization ratio: 80/20; Mw: about 250,000) | 100 parts |
| Magnetite (Si content A = 0.4, Si content B = 1.45, B/A = 3.5; average particle diameter: 0.2 μm) | 100 parts |
| Low molecular polypropylene wax | 3 parts |
| Nigrosine | 2 parts |

Using the above materials, a positively chargeable black toner (amount of triboelectric charges: +12 μc/g) with a volume average particle diameter of 11 μm was prepared in the same manner as in Example 1.

Next, 100 parts of the positively chargeable black toner, 0.4 part of fine silica powder A and 0.5 part of fine polyvinylidene fluoride particles (degree of crystallization: 70%, primary average particle diameter: 0.4 μm; amount of triboelectric charges: −22 μc/g) were blended to give a one-component type positively chargeable developer.

Using the one-component type positively chargeable developer thus prepared, image production was tested in the same manner as in Example 1. Results obtained are shown in Tables 4 and 5.

EXAMPLES 6 to 8

Example 5 was repeated to prepare one-component type positively chargeable developers, except that fine silica powder A was replaced with fine silica powder B, C or D. Image production was tested in the same manner as in Example 1. Results obtained are shown in Tables 4 and 5.

TABLE 4

| Example | Fine silica powder | 23.5° C., 65% RH Initial density | Initial reversal fog $\lvert V'_{DC}-V_{SL}\rvert$ | After 50,000 sheet duration Density | After 50,000 sheet duration $\lvert V'_{DC}-V_{SL}\rvert$ |
|---|---|---|---|---|---|
| 5 | A | 1.40 | ≧330 V | 1.35 | ≧280 V |
| 6 | B | 1.38 | ≧330 V | 1.35 | ≧250 V |
| 7 | C | 1.37 | ≧330 V | 1.30 | ≧280 V |
| 8 | D | 1.40 | ≧330 V | 1.30 | ≧260 V |

TABLE 5

| Example | Fine silica powder | 35° C., 80% RH Initial density | Initial reversal fog $\lvert V'_{DC}-V_{SL}\rvert$ | After 50,000 sheet duration Density | After 50,000 sheet duration $\lvert V'_{DC}-V_{SL}\rvert$ |
|---|---|---|---|---|---|
| 5 | A | 1.33 | ≧330 V | 1.30 | ≧300 V |
| 6 | B | 1.35 | ≧330 V | 1.28 | ≧300 V |
| 7 | C | 1.35 | ≧330 V | 1.30 | ≧300 V |
| 8 | D | 1.30 | ≧330 V | 1.30 | ≧300 V |

EXAMPLE 9

| | |
|---|---|
| Styrene/n-butyl acrylate copolymer (copolymerization ratio: 80/20; Mw: about 220,000) | 100 parts |
| Copper phthalocyanine pigment | 2 parts |
| Low molecular polypropylene | 3 parts |
| Tri-n-butyl-benzyl ammonium salt | 2 parts |
| Aluminum stearate | 0.25 part |

The above materials were thoroughly blended with a blender, followed by kneading with a twin-roll kneader heated to 145° C. The kneaded product was left to cool and thereafter crushed with a cutter mill, followed by pulverization using a jet-air fine pulverizer and further by classification using an air classifier. A positively chargeable cyan toner (amount of triboelectric charges: +20μc/g) with a volume average particle diameter of 13 μm was thus obtained.

Next, 100 parts of the positively chargeable cyan toner. 0.4 part of fine silica powder A and 0.5 part of fine polyvinylidene fluoride particles (degree of crystallization: 70%; primary average particle diameter: 0.4 μm; amount of triboelectric charges: −22 μc/g) were blended to give a positively chargeable cyan toner mixture.

Subsequently, 8 parts of the positively chargeable cyan toner mixture and 92 parts of resin-coated ferrite carrier (obtained by coating spherical ferrite particles of 60 μm in average particle diameter, with an acrylic resin) were blended to prepare a two-component type developer.

The two-component type developer thus prepared was applied in a commercially available copying machine (trade name: NP-5540; manufactured by Canon Inc.), and images were produced. Results obtained are shown in Tables 7 and 8.

EXAMPLES 10 to 22

Example 9 was repeated using the two-component type developer except that the fine polyvinylidene fluoride particles as shown below in Table 6 were used. Images were produced in the same manner as in Example 9. Results obtained are shown in Tables 7 and 8.

TABLE 6

| Example | Degree of crystalization (%) | Primary average particle diameter (μm) | Amount of triboelectric charges (μc/g) |
|---|---|---|---|
| 10 | 77 | 0.2 | −35 |
| 11 | 82 | 0.3 | −32 |
| 12 | 75 | 0.4 | −25 |

TABLE 7

| Example | 23.5° C., 65% RH Initial density | Initial reversal fog $\lvert V'_{DC}-V_{SL}\rvert$ | After 50,000 sheet duration Density | After 50,000 sheet duration $\lvert V'_{DC}-V_{SL}\rvert$ |
|---|---|---|---|---|
| 9 | 1.42 | ≧330 V | 1.35 | ≧280 V |
| 10 | 1.38 | ≧330 V | 1.32 | ≧280 V |
| 11 | 1.38 | ≧330 V | 1.31 | ≧280 V |
| 12 | 1.35 | ≧330 V | 1.38 | ≧300 V |

TABLE 8

| Example | 35° C., 65% RH Initial density | Initial reversal fog $\lvert V'_{DC}-V_{SL}\rvert$ | After 50,000 sheet duration Density | After 50,000 sheet duration $\lvert V'_{DC}-V_{SL}\rvert$ |
|---|---|---|---|---|
| 9 | 1.40 | ≧330 V | 1.30 | ≧300 V |
| 10 | 1.33 | ≧330 V | 1.31 | ≧300 V |
| 11 | 1.33 | ≧330 V | 1.30 | ≧300 V |
| 12 | 1.28 | ≧330 V | 1.32 | ≧300 V |

What is claimed is:

1. A developer for developing electrostatic latent images, comprising a toner and a fine silica powder; said fine silica powder being treated with an aminosilane coupling agent having a tertiary amino group represented by the formula:

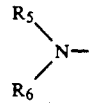

wherein $R_5$ and $R_6$ represent the same or different substituents, provided that the total of the carbon atom number of $R_5$ and $R_6$ is not less than 8, and having an oxidation potential of nOt more than 800 mV.

2. A developer according to claim 1, wherein the fine silica powder treated with said aminosilane coupling agent is made hydrophobic to a degree of not less than 50, measured in a wetting degree test.

3. A developer according to claim 1, wherein said aminosilane coupling agent has a structure represented by the formula:

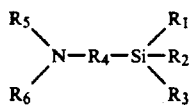

wherein $R_1$ represents an alkoxy group; $R_2$ and $R_3$ may be the same or different and each represent an alkoxy group, an alkyl group or an aryl group; $R_4$ represents an alkylene group or a phenylene group; and $R_5$ and $R_6$ may be the same or different and each represents an alkyl group or an aryl group, provided that the alkylene group or phenylene group may have an amino group.

4. A developer according to claim 3, wherein $R_1$ represents an alkoxy group having 1 to 4 carbon atoms; $R_2$ and $R_3$ each represent an alkoxy group or alkyl group, each having 1 to 4 carbon atoms; $R_4$ represents an alkylene group having 2 to 1O carbon atoms or phenylene group; and $R_5$ and $R_6$ each represent an alkyl group having 2 to 12 carbon atoms or aryl group having 6 to 12 carbon atoms.

5. A developer according to claim 1, wherein said toner comprises a positively chargeable toner.

6. A developer according to claim 5, wherein said toner comprises a positively chargeable toner having an amount of triboelectric charges, of from +5 μc/g to +40 μc/g.

7. A developer according to claim 5, wherein said toner comprises a positively chargeable toner having an amount of triboelectric charges, of from +9 μc/g to +20 μc/g.

8. A developer according to claim 5, wherein said toner comprises a positively chargeable toner having an amount of triboelectric charges, of from +9 μc/g to +25 μc/g.

9. A developer according to claim 1, wherein said toner is mixed with a fine silica powder and negatively chargeable fine fluorine resin particles.

10. A developer according to claim 9, wherein said negatively chargeable fine fluorine resin particles have a primary average particle diameter of from 0.01 to 4 μm.

11. A developer according to claim 9, wherein said negatively chargeable fine fluorine resin particles have a primary average particle diameter of from 0.1 to 3 μm.

12. A developer according to claim 9, wherein said negatively chargeable fine fluorine resin particles have an amount of triboelectric charges, of −10 μc/g to −40 μc/g.

13. A developer according to claim 9, wherein said negatively chargeable fine fluorine resin particles have a degree of crystallization, of not less than 60%.

14. A developer according to claim 9, wherein said negatively chargeable fine fluorine resin particles have a degree of crystallization, of not less than 70%.

15. A developer according to claim 1, wherein said fine silica powder has an amount Of triboelectric charges, of from +100 μc/g to +300 μc/g.

16. A developer according to claim 1, wherein said fine silica powder is contained in an amount of from 0.05 to 10 parts by weight based on 100 parts by weight of the toner.

17. A developer according to claim 1, wherein said fine silica powder is contained in an amount of from 0.1 to 3 parts by weight based on 100 parts by weight of the toner.

18. A developer according to claim 9, wherein said fine silica powder is mixed in an amount of from 0.05 to 10 parts by weight based on 100 parts by weight of the tOner, and said negatively chargeable fine fluorine resin particles are mixed in an amount of from 0.01 to 5 parts by weight based on 100 parts by weight of the toner.

19. A developer according to claim 9, wherein said fine silica powder is mixed in an amount of from 0.1 to 3 parts by weight based on 100 parts by weight of the toner, and said negatively chargeable fine fluorine resin particles are mixed in an amount of from 0.05 to 2 parts by weight based on 100 parts by weight of the toner.

20. A developer according to claim 1, wherein said toner comprises a positively chargeable magnetic toner.

21. A developer according to claim 20, wherein said positively chargeable magnetic toner has an amount of triboelectric charges, of from +9 μc/g to +20 μc/g and has a volume average particle diameter of from 5 to 30 μm.

22. A developer according to claim 20, wherein said positively chargeable magnetic toner comprises a binder resin and magnetic fine particles; said magnetic fine particles being contained in an amount of from 10 to 70% by weight based on the toner weight.

23. A developer according to claim 22, wherein the fine silica powder treated with said aminosilane coupling agent is made hydrophobic to a degree of not less than 50, measured in a wetting degree test.

24. A developer according to claim 23, wherein said aminosilane coupling agent has a structure represented by the formula:

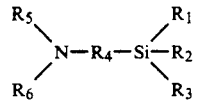

wherein $R_1$ represents an alkoxy group; $R_2$ and $R_3$ may be the same or different and each represent an alkoxy group, an alkyl group or an aryl group; $R_4$ represents an alkylene group or a phenylene group; and $R_5$ and $R_6$ may be the same or different and each represents an alkyl group or an aryl group, provided that the alkylene group or phenylene group may have an amino group.

25. A developer according to claim 24, wherein $R_1$ represents an alkoxy group having 1 to 4 carbon atoms; $R_2$ and $R_3$ each represent an alkoxy group or alkyl group, each 1 to 4 carbon atoms; $R_4$ represents an alkylene group having 2 to 10 carbon atoms or phenylene group; and $R_5$ and $R_6$ each represent an alkyl group having 2 to 12 carbon atoms or aryl group having 6 to 12 carbon atoms.

26. A developer according to claim 22, wherein said toner is mixed with a fine silica powder and negatively chargeable fine fluorine resin particles.

27. A developer according to claim 26, wherein said negatively chargeable fine fluorine resin particles have a primary average particle diameter of from 0.01 to 4 μm.

28. A developer according to claim 26, wherein said negatively chargeable fine fluorine resin particles have a primary average particle diameter of 0.1 to 3 μm.

29. A developer according to claim 26, wherein said negatively chargeable fine fluorine resin particles have an amount of triboelectric charges, of $-10\ \mu c/g$ to $-40\ \mu c/g$.

30. A developer according to claim 26, wherein said negatively chargeable fine fluorine resin particles have a degree of crystallization, of not less than 60%.

31. A developer according to claim 26, wherein said negatively chargeable fine fluorine resin particles have a degree of crystallization, of not less than 70%.

32. A developer according to claim 26, wherein said fine silica powder has an amount of triboelectric charges, of from $+100\ \mu c/g$ to $+300\ \mu c/g$.

33. A developer according to claim 24, wherein said fine silica powder is contained in an amount of from 0.05 to 10 parts by weight based on 100 parts by weight of the toner.

34. A developer according to claim 24, wherein said fine silica powder is contained in an amount of from 0.1 to 3 parts by weight based on 100 parts by weight of the toner.

35. A developer according to claim 26, wherein said fine silica powder is mixed in an amount of from 0.05 to 10 parts by weight based on 100 parts by weight of the toner, and said negatively chargeable fine fluorine resin particles are mixed in an amount of from 0.01 to 5 parts by weight based on 100 parts by weight of the toner.

36. A developer according to claim 26, wherein said fine silica powder is mixed in an amount of from 0.1 to 3 parts by weight based on 100 parts by weight of the toner, and said negatively chargeable fine fluorine resin particles are mixed in an amount of from 0.05 to 2 parts by weight based on 100 parts by weight of the toner.

* * * * *

UNITED STATES PATENT AND TRADEMARK OFFICE

CERTIFICATE OF CORRECTION

PATENT NO. : 5,024,915

DATED : June 18, 1991

INVENTOR(S) : Yukou Sato, et al

It is certified that error appears in the above-identified patent and that said Letters Patent is hereby corrected as shown below:

Title Page:

IN [56] REFERENCES CITED

FOREIGN PATENT DOCUMENTS, "1015153 1/1986 Japan" should read --61-15153 1/1986 Japan-- and "2061009 3/1987 Japan" should read --62-61609 3/1987 Japan--.

COLUMN 1

Line 10, "trostatio" should read --trostatic--.
Line 21, "eleotrophotography" should read --electrophotography--.
Line 32, "hear" should read --heat--.

COLUMN 2

Line 8, "comes" should read --come--.
Line 18, "include," should read --includes,--.
Line 55, "$H_3N—NHCONHC_3H_6Si(OCH_3)_3$" should read --$H_3C—NHCONHC_3H_6Si(OCH_3)_3$--.

COLUMN 3

Line 11, "ion" should read --iron--.
Line 29, "diphenyldiethoxysilnane" should read --diphenyldiethoxysilane--.

UNITED STATES PATENT AND TRADEMARK OFFICE

CERTIFICATE OF CORRECTION

PATENT NO. : 5,024,915

DATED : June 18, 1991

INVENTOR(S) : Yukou Sato, et al

It is certified that error appears in the above-identified patent and that said Letters Patent is hereby corrected as shown below:

COLUMN 4

Line 3, "No. 4,666,813" should read --No. 4,666,813)--.
Line 29, "than" should read --that--.
Line 64, "represent" should read --represents--.
Line 67, "represent" should read --represents--.

COLUMN 5

Line 59, "Of" should read --of--.

COLUMN 6

Line 35, "Aerosil I30," should read --Aerosil 130,--.

COLUMN 7

Line 17, "Quaetz" should read --Quartz--.
Line 18, "Illinis" should read --Illinois--.
Line 65, "draw" should read --drawn--.

COLUMN 8

Line 1, "(tranSmittance" should read --(transmittance--.
Line 14, "om" should read --cm--.
Line 35, "a" should be deleted.
Line 40, "having" should be deleted.
Line 42, "tiOnal" should read --tional--.

UNITED STATES PATENT AND TRADEMARK OFFICE

CERTIFICATE OF CORRECTION

PATENT NO. : 5,024,915

DATED : June 18, 1991

INVENTOR(S) : Yukou Sato, et al

It is certified that error appears in the above-identified patent and that said Letters Patent is hereby corrected as shown below:

COLUMN 9

Line 68, "ar" should read --are--.

COLUMN 10

Line 62, "1OO" should read --100--.

COLUMN 11

Line 25, "ferrite" should read --ferrite.--.
Line 30, "irOn" should read --iron--.
Line 45, "element" should read --element)--.

COLUMN 12

Line 2, "of" (first occurrence) should be deleted.

COLUMN 13

Line 4, "0.4 μm:" should read --0.4 μm;--.
Line 5, "there" should read --these--.
Line 16, "System" should read --system--.
Line 25, "VDC" should read --$V_{DC}$--.
Line 26, "VDC" should read --$V_{DC}$--.
TABLE 1, "C 200 m2/g" should read --C 200$m^2$/g--.

UNITED STATES PATENT AND TRADEMARK OFFICE

CERTIFICATE OF CORRECTION

PATENT NO. : 5,024,915

DATED : June 18, 1991

INVENTOR(S) : Yukou Sato, et al

It is certified that error appears in the above-identified patent and that said Letters Patent is hereby corrected as shown below:

COLUMN 14

Line 11, "well" should read --very--.
Line 18, "replace" should read --replaced--.
Line 20, "potentiaI:" should read --potential:--.
Line 21, "900 mV" should read --900 mV)--.

COLUMN 15

Line 59, "toner." should read --toner,--.

COLUMN 16

TABLE 8, " Density 1.30" should read -- Density 1.33 --.

Line 63, "nOt" should read --not--.

COLUMN 17

Line 21, "2 to 10" should read --2 to 10--.
Line 38, "+25 μc/g." should read --+15 μc/g.--.
Line 61, "Of" should read --of--.

UNITED STATES PATENT AND TRADEMARK OFFICE

CERTIFICATE OF CORRECTION

PATENT NO. : 5,024,915

DATED : June 18, 1991

INVENTOR(S) : Yukou Sato, et al

It is certified that error appears in the above-identified patent and that said Letters Patent is hereby corrected as shown below:

COLUMN 18

Line 6, "tOner," should read --toner,--.
Line 51, "each" should read --each having--.

Signed and Sealed this

Twenty-fifth Day of May, 1993

*Attest:*

Michael K. Kirk

MICHAEL K. KIRK

*Attesting Officer*

*Acting Commissioner of Patents and Trademarks*